US009896811B2

(12) United States Patent
McAdam et al.

(10) Patent No.: US 9,896,811 B2
(45) Date of Patent: Feb. 20, 2018

(54) APPARATUS FOR REMOVING UNWANTED MATERIAL FROM THE GROUND

(75) Inventors: Jim McAdam, Dundalk (IE); Gerry McHugh, Carrickmacross (IE)

(73) Assignee: MULTIHOG R & D LIMITED, Dundalk, County Louth (IE)

( * ) Notice: Subject to any disclaimer, the term of this patent is extended or adjusted under 35 U.S.C. 154(b) by 262 days.

(21) Appl. No.: 14/384,948

(22) PCT Filed: Mar. 16, 2012

(86) PCT No.: PCT/EP2012/054740

§ 371 (c)(1),
(2), (4) Date: Sep. 12, 2014

(87) PCT Pub. No.: WO2013/135309

PCT Pub. Date: Sep. 19, 2013

(65) Prior Publication Data

US 2015/0033589 A1 Feb. 5, 2015

(51) Int. Cl.
*E01H 5/06* (2006.01)
*E01H 5/09* (2006.01)
(Continued)

(52) U.S. Cl.
CPC ..... *E01H 5/092* (2013.01); *E01H 5/06* (2013.01); *E01H 5/061* (2013.01); *E01H 5/098* (2013.01);
(Continued)

(58) Field of Classification Search
CPC ..... E02F 3/7622; E02F 3/7627; E02F 3/76; E02F 3/7613; E01H 5/06; E01H 5/061
(Continued)

(56) References Cited

U.S. PATENT DOCUMENTS 3,230,645 A * 1/1966 Lutz ..... E01H 5/06 15/82
3,613,800 A * 10/1971 Martin ..... A01B 63/023 172/445.2
(Continued)

FOREIGN PATENT DOCUMENTS

DE 20 42 926 A1 6/1972
DE 36 43 080 A1 6/1988
(Continued)

OTHER PUBLICATIONS

International Search Report for PCT/EP2012/054740 dated Jan. 18, 2013.
Written Opinion for PCT/EP2012/054740 dated Jan. 18, 2013.

*Primary Examiner* — Matthew D. Troutman
(74) *Attorney, Agent, or Firm* — Sughrue Mion, PLLC

(57) ABSTRACT

An apparatus for removing material from the ground is disclosed, with a path-clearing blade, a vehicle mounting, a body supporting the blade, and a jointed connection between the vehicle mounting and the body permitting the axis of the blade and body to rotate within a plane parallel to the ground. The jointed connection has first and second pivot arm each pivotally connected about a proximal axis of rotation relative to the vehicle mounting and pivotally connected about a distal axis of rotation relative to the body. As the body's axis rotates in the clockwise sense, the first and second arms each pivot counterclockwise about their respective proximal axes of rotation, and vice versa. The arms are preferably disposed above the body and the distal axes of rotation are mounted forwardly of the rear edge of a horizontal rotating brush mounted in the body behind the blade.

21 Claims, 11 Drawing Sheets

(51) Int. Cl.
*E02F 3/76* (2006.01)
*E02F 3/815* (2006.01)
*E02F 3/96* (2006.01)

(52) U.S. Cl.
CPC ..... *E02F 3/7627* (2013.01); *E02F 3/7631* (2013.01); *E02F 3/8157* (2013.01); *E02F 3/962* (2013.01)

(58) Field of Classification Search
USPC ..... 172/272, 273, 810, 811, 818; 37/231, 37/234
See application file for complete search history.

(56) References Cited

U.S. PATENT DOCUMENTS 3,670,825 A * 6/1972 Asal ..... E02F 3/7627 172/663
3,748,675 A * 7/1973 Schultz ..... E01H 1/045 15/4
4,061,194 A * 12/1977 McCanse ..... E02F 3/844 172/260.5
4,306,625 A * 12/1981 Davis ..... E02F 3/8157 172/701.1
4,564,073 A * 1/1986 Ide ..... A01B 15/14 172/120
4,643,261 A * 2/1987 Long ..... E01H 1/056 15/82
4,821,810 A * 4/1989 Buchanan ..... E02F 3/815 172/197
5,285,588 A * 2/1994 Niemela ..... E01H 5/065 37/232
5,974,702 A * 11/1999 Donoghue ..... E01H 5/062 172/819
6,408,548 B1 * 6/2002 Altheide ..... E01H 5/068 37/232
7,861,347 B2 * 1/2011 McKeown ..... A46B 13/001 15/21.1
2011/0035968 A1 * 2/2011 Wagger ..... E01H 4/02 37/223
2015/0152613 A1 * 6/2015 Ockunzzi ..... E01H 5/061 37/266

FOREIGN PATENT DOCUMENTS

DE 43 05 648 A1 2/1994
DE 197 45 887 A1 8/1998
EP 0 587 175 A1 3/1994
WO 97/41309 A1 11/1997

* cited by examiner

Prior Art

Prior Art

APPARATUS FOR REMOVING UNWANTED MATERIAL FROM THE GROUND

CROSS REFERENCE TO RELATED APPLICATIONS

This application is a National Stage of International Application No. PCT/EP2012/054740 filed Mar. 16, 2012, the contents of all of which are incorporated herein by reference in their entirety.

TECHNICAL FIELD

This invention relates to apparatuses such as snowploughs for removing unwanted material from the ground.

BACKGROUND ART

Snowploughs can be single-purpose integral machines, having a plough permanently mounted on a vehicle with an engine, designed specifically for the purpose of clearing snow and ice from a roadway or other surface. Alternatively, a snowplough may be provided as an add-on or accessory which is to be mounted on a general purpose vehicle such as a truck or tractor or a multipurpose implement carrier.

When a snowplough is provided as an accessory, it is typically mounted to the front of the vehicle, but sometimes to the rear. Some ploughs are designed to be slanted permanently to the near-side of the vehicle (i.e. closest to the kerb in normal traffic flow), so that in use, snow is displaced towards the kerb. Other ploughs are designed to be more versatile, with the slant angle being variable or switchable, so that the plough can displace snow and ice sideways either to the left or right, this being also useful in open spaces with no kerbs.

The simplest way of achieving this is to mount the plough on a pivot, so that the blade of the plough can be swung to one side or the other. In other words, the right side edge of the blade can be advanced ahead of the left when the plough is swung in the counter-clockwise direction (when viewed from above) or the left side edge can be advanced ahead of the right when the plough is swung clockwise. In the former configuration, as the plough is driven forward, it displaces snow to the left, and in the latter configuration to the right. For ease of reference the former configuration will be described herein as a left-displacing plough and the latter as a right-displacing plough.

A disadvantage of this simple arrangement is that the pivoting action of the plough, as it swings relative to the vehicle, also results in lateral displacement of the plough. Thus, the leading edge will move laterally across the straight-ahead line of travel of the vehicle in the same direction as the displacement direction of the snow, i.e. the leading right-hand edge moves left when the plough is left-displacing and right when the plough is right-displacing.

FIG. 1 shows such a plough 10 mounted on the front 12 of a vehicle having a body 14 and wheels, of which only the left front wheel 16 and right front wheel 18 are shown. (As the vehicle's direction of travel is down the page, the left and right are reversed in this view). The connection between the vehicle mounting 20 and the plough body 22 takes the form of two triangular plates 24, 26 pivoted together about a pivot point 28.

A plough blade 30 at the front of the plough body 22 clears a path when the plough is lowered and driven forward over the ground in a direction of forward travel 32. The cleared path is defined between a pair of parallel dot-dash lines 34, 36 defined by the path of the right and left edges respectively of the plough in the direction of travel. The tracks of the left and right wheels are shown by dashed lines 38, 40 (for the left wheel 16) and 42, 44 (for the right wheel 18). It can be seen that the wheel tracks lie within the ploughed area, giving the vehicle traction in adverse conditions.

Also seen in FIG. 1 are a pair of castors 46 (which could be replaced by slides) on which the plough body is additionally supported. Not visible in FIG. 1, but of relevance, is a rotatable cylindrical brush which is mounted within the plough body 22 with its axis (indicated by a broken line 48) parallel to and behind the blade 30 of the plough. The plough blade can be selectively raised and the brush lowered to the ground, and the brush rotated so that it can sweep remaining snow on e.g. a second pass over the ploughed ground, or when used over other debris or snow which is not so deep as to require the snowplough. Alternatively the blade can be lowered to contact the ground, raising the brush during ploughing. The operation and raising and lowering of the brush and plough can be independently controlled, or can be linked to a common selection control.

FIG. 2 shows the same plough in use, when slanted in a counter-clockwise direction when viewed from above. In other words, the plough is in a left-displacing configuration. The right-displacing configuration is a mirror image.

Now it can be seen that the pivoting of the plough body 22 about the pivot point 28 results in the lateral displacement or translation of the plough body and in particular the blade 30 across the direction of travel. The result is that the cleared path 34, 36 is no longer aligned with the vehicle, and the right wheel track 42, 44 is no longer within the cleared path's right-hand edge 34, and the effective width of the vehicle has increased. Even if the plough is much wider than the vehicle so that the vehicle remains within the ploughed path, the arrangement involves a considerable swinging of the plough from one side to another as the angle changes.

One solution is to make the plough wide enough that it will extend to cover the tracks of both wheels, regardless of its orientation. However, this results in a plough and vehicle which is significantly less manoeuvrable, especially in narrow spaces, such as along pathways or between aeroplanes at an airport.

DISCLOSURE OF THE INVENTION

There is provided an apparatus for removing unwanted material from the ground when the apparatus is driven across the ground by the vehicle, the apparatus comprising:

a) a vehicle mounting permitting attachment of the apparatus to a vehicle;

b) a body supporting a path-clearing blade, the blade having a longitudinal axis generally parallel to the ground in use, defining an axis of the body; and c) a jointed connection between the vehicle mount and the body permitting the axis of the body to rotate within a plane generally parallel to the ground in use, the jointed connection comprising at least one pivot arm which pivots in a counter-clockwise sense relative to the vehicle mount as the body's axis rotates in the clockwise sense, and vice versa.

The counter-rotation of the pivot arm relative to the direction of rotation of the body's axis serves to translate the body in a direction which counteracts the natural swinging movement due to pivotal rotation of the body about the axis.

Preferably, the jointed connection comprises:

i. a first pivot arm pivotally connected about a first proximal axis of rotation relative to the vehicle mounting and pivotally connected about a first distal axis of rotation relative to the body, and ii. a second pivot arm pivotally connected about a second proximal axis of rotation relative to the vehicle mounting and pivotally connected about a second distal axis of rotation relative to the body, wherein as the body's axis rotates in the clockwise sense relative to the ground, the first and second arms each pivot in a counter-clockwise sense about their respective proximal axes of rotation, and vice versa.

Thus, in comparison to a body mounted on a simple pivot arm, which swings laterally away from the neutral position when rotated to a slanted angle, the jointed connection of the invention permits the body to adopt a slanted orientation without significant lateral displacement.

Preferably, one of the pivot arms is a load-bearing arm, and the other is a link arm which is not load-bearing but which constrains the movement of the body.

Preferably, the separation between the first and second proximal axes of rotation is greater than the separation between the first and second distal axes of rotation.

Thus, the four axes of rotation define the vertices of a quadrilateral, with the first and second pivot arms defining two of the opposed sides of the quadrilateral, where the quadrilateral tapers from the mounting end towards the body end.

(For the avoidance of doubt the quadrilateral may be regular or irregular. Irregular quadrilaterals are of the type known as a trapezium in North America and a trapezoid in the UK and Ireland, where no two sides are parallel. Regular quadrilaterals have the opposite names trapezoid in North America and trapezium in the UK and Ireland and are distinguished by at least two sides being parallel.)

Most preferably, the geometry of the arms and the axes of rotation is selected to constrain the body to always be centred on approximately the same line, this being the centreline of travel of the vehicle.

The body can also be constrained, by the jointed connection to lie within substantially the same width, regardless of the angle of rotation adopted by the body. By "substantially the same width" it is meant that the lateral extremities of the body when rotated away from the neutral position do not stray by more than a threshold amount on either side outside the body's lateral extent when it is in the neutral position.

The threshold amount can be defined in terms of the width of the plough itself or the width of the vehicle. Preferably, the threshold amount is not more than 12.5% of the plough blade's width, more preferably not more than 10%. In particularly preferred embodiments the threshold amount is not more than about 8% and most especially not more than 6%. For example, one embodiment confines the lateral movement of a 1500 mm wide blade to move no more than 120 mm outside the neutral path of the blade on either side, and a currently preferred embodiment confines the lateral movement to 85 mm respectively giving threshold amounts of 8% and 5.6%. The arrangements described herein can be modified to confine the blade entirely within its neutral position width for all angles of operation. In this way, the body can be rotated through a range of angles, preferably to both sides, without significant lateral translation. Where the width of the body of the apparatus is approximately equal to the width of the vehicle body (or of the wheelbase track width) then the body will continue to clear the same track (adjusted for the slight narrowing due to the offset of the blade, i.e. the cos $\alpha$ factor.

Preferably, the blade can be rotated to either side through an angle of at least 20 degrees relative to a neutral position, more preferably at least 25 degrees, and most preferably 28-33 degrees. For a snow plough this angular offset allows efficient clearing of snow, ice and other debris.

The first and second pivot arms are preferably rigid.

While compound (articulated) arms may be employed, the simplest and presently preferred form is a rigid, simple arm in each case extending from the respective proximal axis to the distal axis of rotation.

Preferably, the apparatus further comprises a driven means for moving the body relative to the mounting.

The driven means is preferably selected from a hydraulic, pneumatic or mechanical mechanism.

The apparatus may optionally comprise a power source, or it may comprise a coupling to a suitable power source for driving the driven means.

Most preferably, the driven means is a hydraulic cylinder operable to vary the rotation angle of the body relative to the mounting as it is extended and contracted.

In a preferred embodiment, the apparatus is embodied in a snow plough.

More preferably, the apparatus further comprises a rotatable brush disposed on the body.

The brush is preferably disposed behind the plough blade.

Preferably the vertical height of the blade can be varied relative to the brush to selectively bring either the brush or blade into proximity or contact with the ground.

Preferably, at least one and preferably both of the distal axes of rotation are disposed forwardly of the rear edge of the brush in the direction of the blade.

More preferably, at least one and preferably both of the distal axes of rotation are disposed forwardly of the axis of the rotatable brush in the direction of the blade.

In another aspect, the invention provides a snowplough accessory for mounting on a vehicle, comprising:

a) a body supporting a snowplough blade at a front side thereof, the blade having a longitudinal axis generally parallel to the ground in use, defining an axis of the body;

b) a rotatable cylindrical brush mounted on the body rearwardly of the snowplough blade with its axis parallel to the axis of the body;

c) a vehicle mounting permitting attachment of the apparatus to a vehicle;

d) a pivoting connection between the vehicle mount and the body permitting the axis of the body to rotate within a plane generally parallel to the ground in use;

wherein the pivoting connection comprises an arm which extends from the vehicle mount to a pivot point on the body, the pivot point being located above or forward of the brush, and the arm extending to the pivot point over the top of the brush such that in normal use the brush is located below the arm and above the ground.

Preferably, the pivot point is located above or forward of the axis of rotation of the brush.

Typical known snowplough accessories of this kind (i.e. combined snowplough and brush) have a plough blade carried forwardly of a rotatable brush, both mounted in a body or housing. The housing is mounted on the vehicle by a connection arrangement (see for example the plates 24, 26 and pivot 28 in FIG. 1) which is carried on the body rearwardly of the brush.

A pivot arm which extends over the top of the brush to a pivot point on the body which is carried above or forwardly of at least the rear edge of the brush and more preferably above or forwardly of the axis of the brush provides a significant advantage in that the accessory is more compact, and any tendency to lateral swinging is significantly reduced.

The preferred features of the first aspect of the invention enumerated earlier and in the dependent claims are equally applicable to the second independent aspect of the invention but not separately enumerated here for conciseness.

DETAILED DESCRIPTION OF PREFERRED EMBODIMENTS

Figure 1:
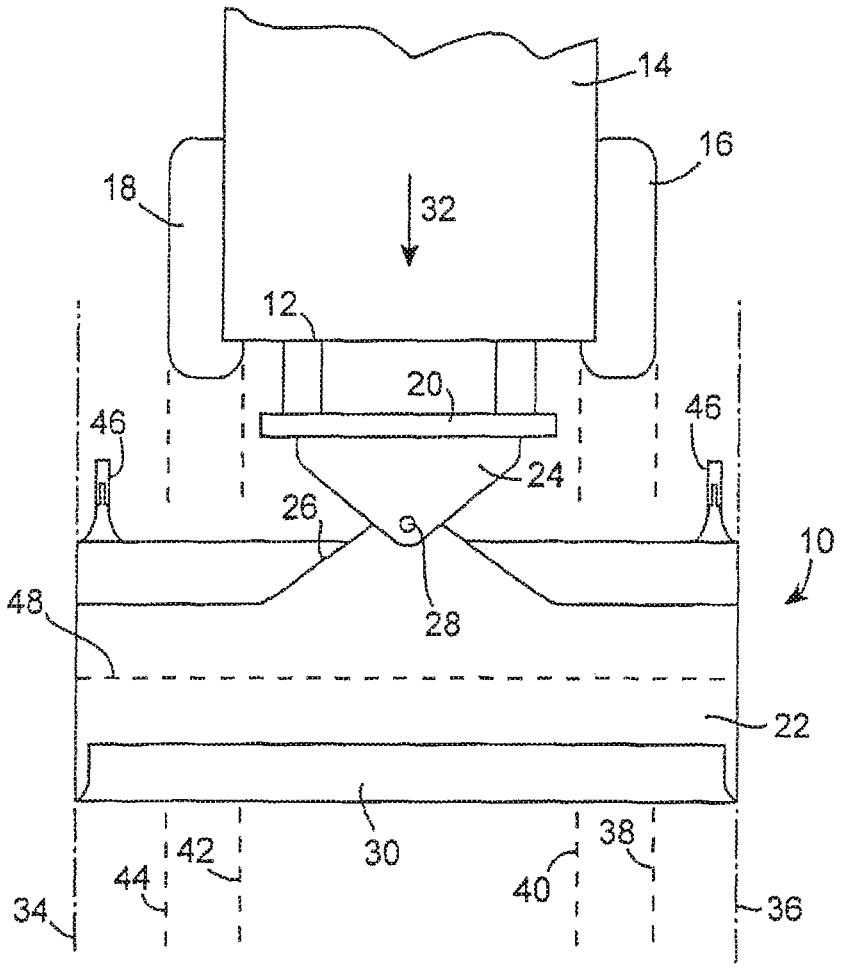
FIG. 1 is a schematic overhead view of a known snowplough connected to the front of a vehicle body, when in a neutral (straight-ahead) position.

Referring to FIGS. 3-6, an apparatus 50 according to the invention is shown from different perspective viewpoints. The apparatus 50 comprises a snowplough body 52 having a snowplough blade 54 mounted at the front end 56 thereof, and a cylindrical roller brush 58 mounted with its major longitudinal axis parallel to the axis of the blade 54 at a position intermediate the blade and the rear end 60 of the apparatus 50.

The blade is carried at either side on a swivel arrangement 62 which permits it to be raised and lowered (by hydraulic control 64) relative to the body 52. A spring 66 biases the front breakaway edge of the plough into its normal working position, but allows the bottom edge to breakaway by pivoting up and back when a hard obstruction is struck, in known manner.

A pair of rear castor wheels 68 support the rear end 60 of the apparatus on the ground, so that the combined load of the body, plough and brush is primarily supported by the castors 68 and the pivot arm 74 (described below). The same unit could be fully supported on a load-bearing pivot arm from the front of a tractor without any castors, slides or other ground-engaging support.

The blade height when in the lowered position can be controlled, and is adjustable to give the required clearance over the surface being ploughed, with typical adjustments being 0-20 mm above the ground surface The brush 58 can be lowered to the ground under air pressure when the blade is raised, to contact the ground and sweep the ground by rotation of the brush, again in known manner.

Rearward of the body 52 is a vehicle mounting 70 which could take many forms but in the illustrated embodiment is in the form of a plate having a recess 72 which is adapted to receive a complementary mounting structure (not shown) provided on a vehicle. The form of the vehicle mounting shown is proprietary but can be varied to suit any particular vehicle's pick-up and mounting system.

The vehicle mounting is connected to the apparatus body by a jointed connection in the form of a first pivot arm 74 and a second pivot arm 76, which will be described now in further detail with reference to FIG. 7.

Figure 7:
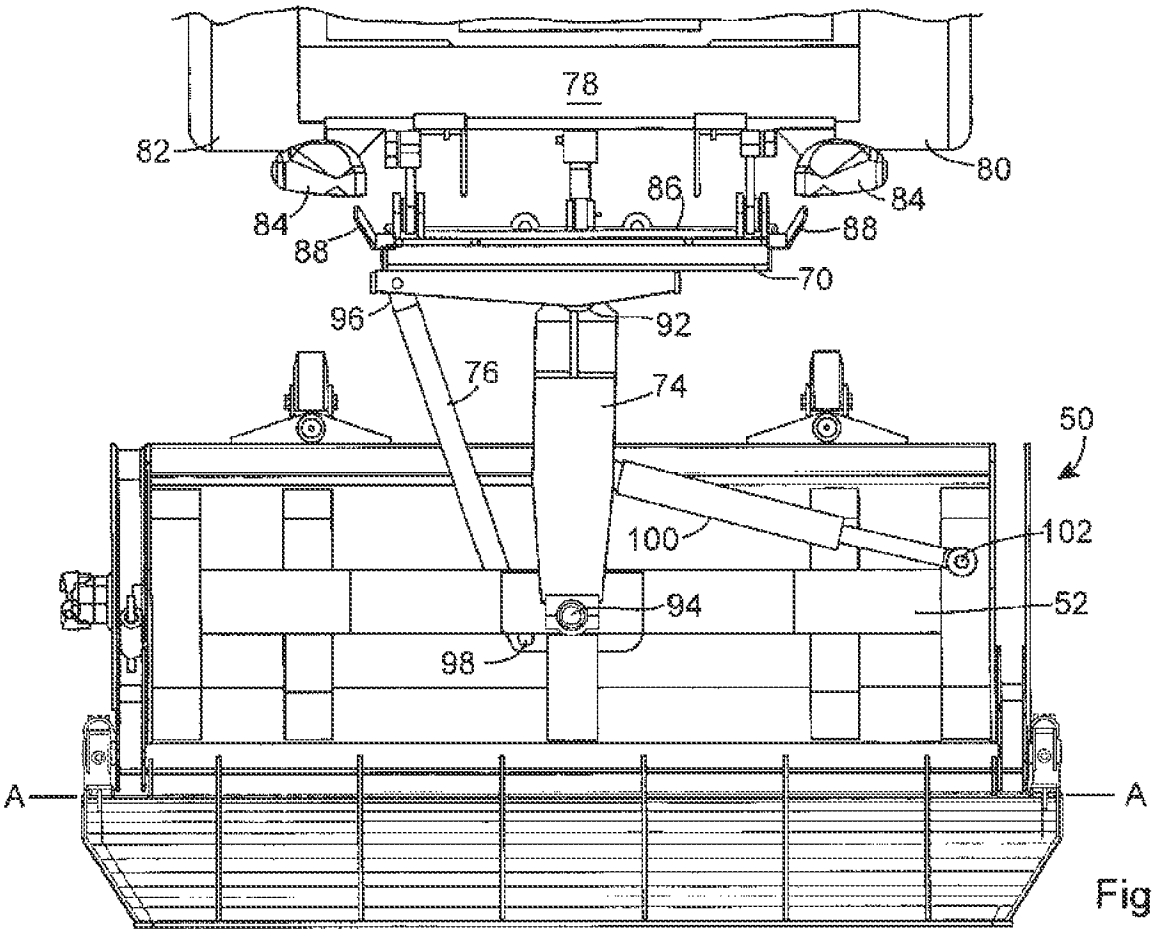
FIG. 7 is a top plan view of the apparatus of FIG. 3, when attached to the front of a vehicle and when in a neutral position.

In FIG. 7, the apparatus 50 is shown mounted on a vehicle the front of which 78 is illustrated. One can see in FIG. 7 the left front wheel 80, right front wheel 82, front headlights 84 and a proprietary pick-up and mounting structure 86 which engages with the vehicle mounting 70 of the apparatus 50. Lock bolts 88 project inwardly into receiving holes 90 (FIG. 4) provided in the vehicle mounting to secure the apparatus on the mounting structure 86 of the vehicle 78.

The apparatus 50 is shown in FIG. 7 in a neutral position, i.e. with the axis defined by the blade, shown as A-A transverse to the straight-ahead direction of travel of the vehicle. The first pivot arm 74, which is connected at a first proximal axis of rotation 92 to the vehicle mounting and at a first distal axis of rotation 94 to the body 52, is parallel to the direction of travel of the vehicle. This is a load-bearing arm and can be thought of as taking the place of a primary pivot arm in a conventional arrangement.

The second pivot arm 76 is connected which is connected at a second proximal axis of rotation 96 to the vehicle mounting, and at a second distal axis of rotation 98 to the body 52. This arm 76 is not load-bearing but acts as a link arm constraining the movement of the body. The second pivot arm 76 is arranged to converge towards the first pivot arm as it approaches the apparatus body 52.

The four axes of rotation 92, 94, 96, 98 define the vertices of an irregular quadrilateral, with the first and second pivot arms 74, 76 defining two of the opposed sides of the quadrilateral, where the quadrilateral tapers from the mounting end 92, 96 towards the body end 94, 98.

The body can be rotated clockwise or counter-clockwise from the position shown in FIG. 7 by the action of a hydraulic cylinder 100 which, in the embodiment shown extends from approximately the middle of the first pivot arm to a pivot point 102 located on the top of the body. It will be appreciated that other motive mechanisms may be used such as electrical motors, pneumatic mechanisms, geared arrangements driven by a power take-off from the body, or any other suitable means for applying a rotating force. Also, where an extending cylinder arrangement such as the hydraulic cylinder 100 is used, this may be provided between alternative connection points, e.g. between either arm 74, 76 and either of the body 52 and mounting 70, or directly between the mounting 70 and body 52.

Figure 8:
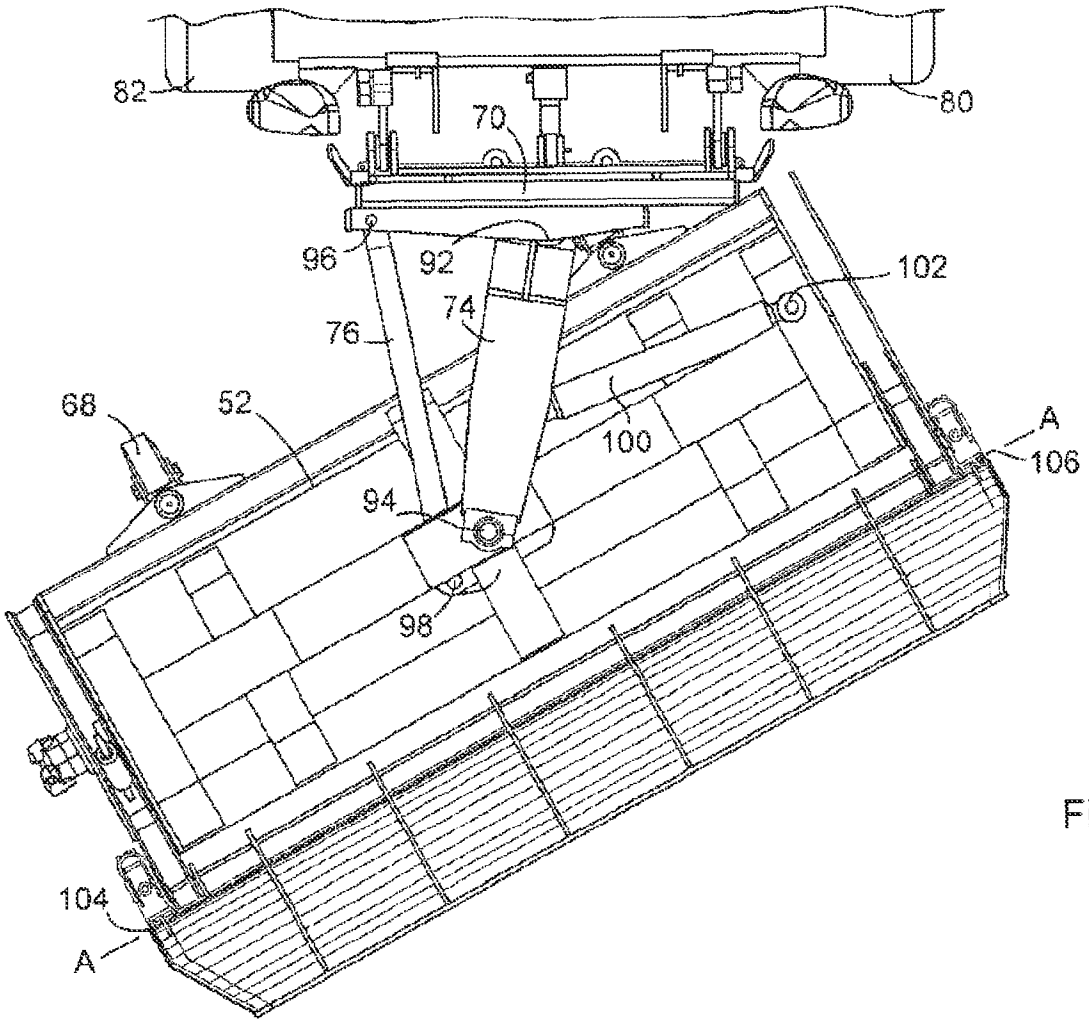
FIG. 8 is a top plan view, similar to FIG. 7, with the apparatus in a left-displacing configuration.

Referring next to FIG. 8, the apparatus is shown having been rotated counter-clockwise (as viewed from above), i.e.

to a left-displacing position. This has been achieved by contracting the cylinder 100 to draw the cylinder's pivot point 102 closer to the first pivot arm 74. The distances between each adjacent pair of the four vertices, i.e. the distances 92-94, 94-98, 98-96, and 96-92, are fixed in length but the internal angles at each vertex are variable. The angles at vertices 94 and 96 have opened up and those at vertices 92 and 98 have become more acute.

Figure 2:
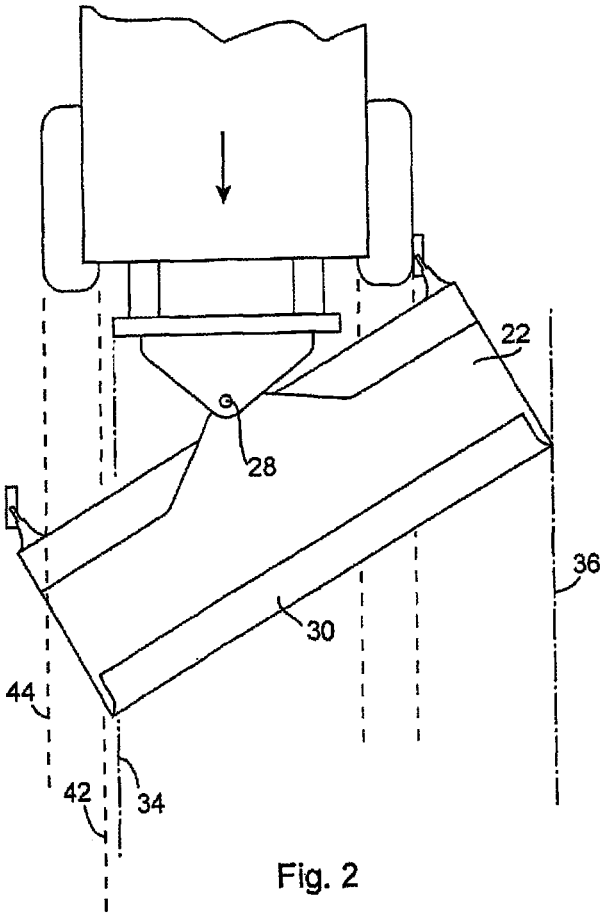
FIG. 2 is a schematic view of the known snowplough of FIG. 1, when slanted to the left-displacing configuration.
Figure 3:
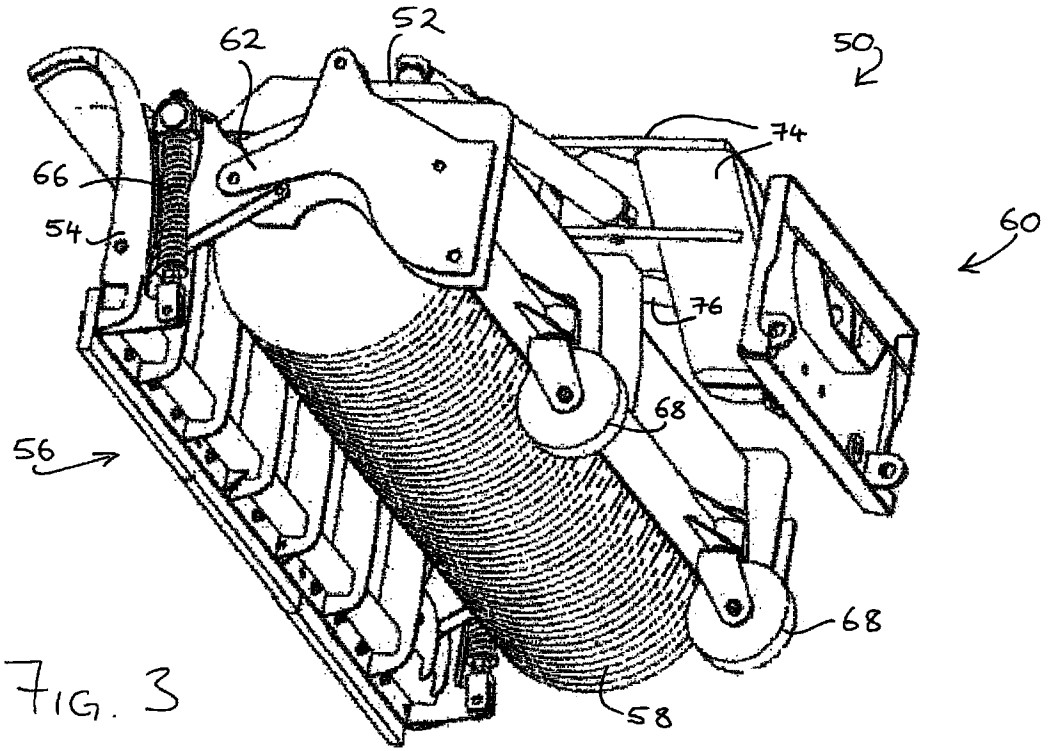
FIG. 3 is a perspective view of an apparatus according to the invention, in perspective view from behind and below.
Figure 4:
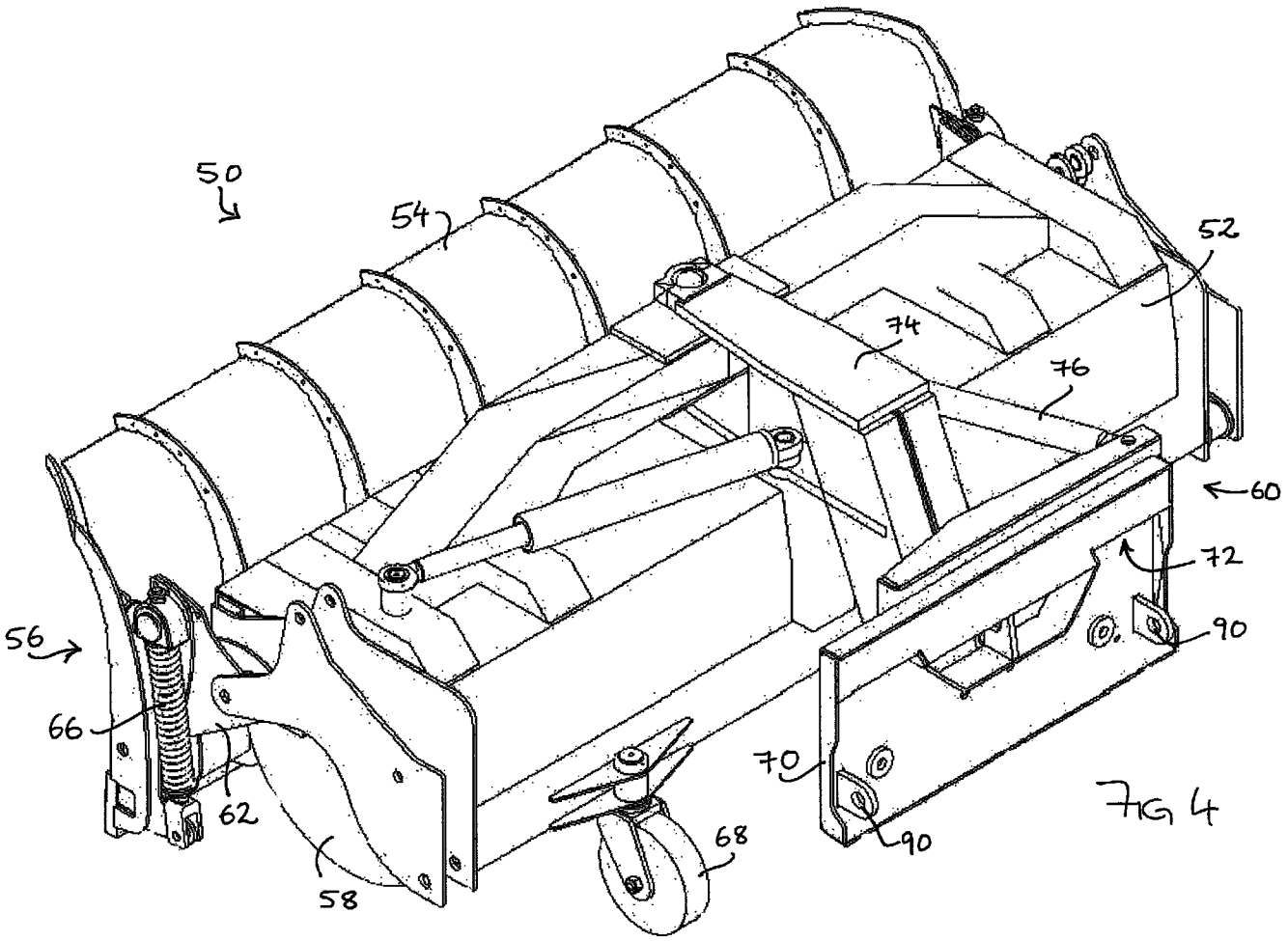
FIG. 4 is a perspective view of the apparatus of FIG. 3, in perspective view from behind and above.
Figure 5:
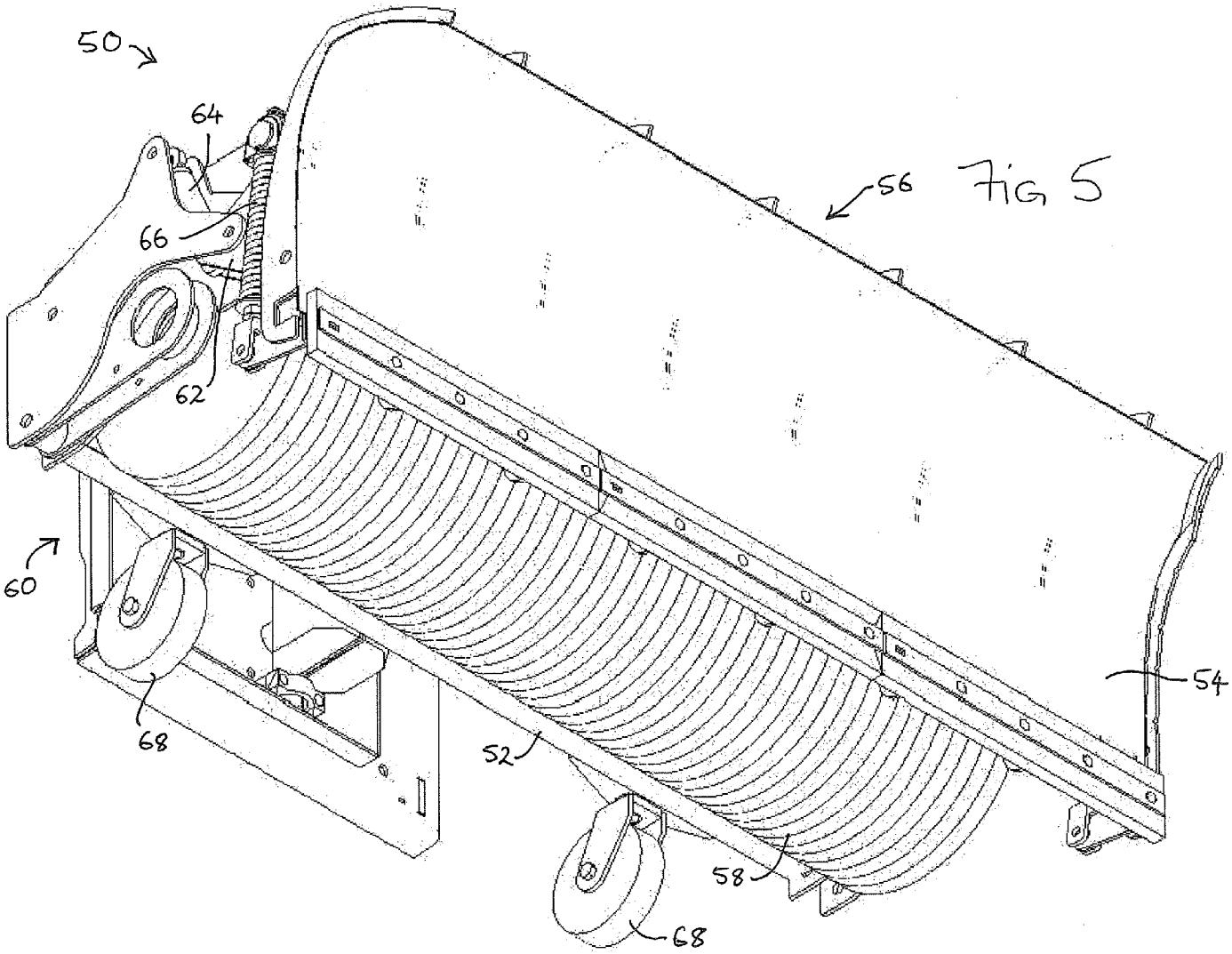
FIG. 5 is a perspective view of the apparatus of FIG. 3, in perspective view from in front and below.
Figure 6:
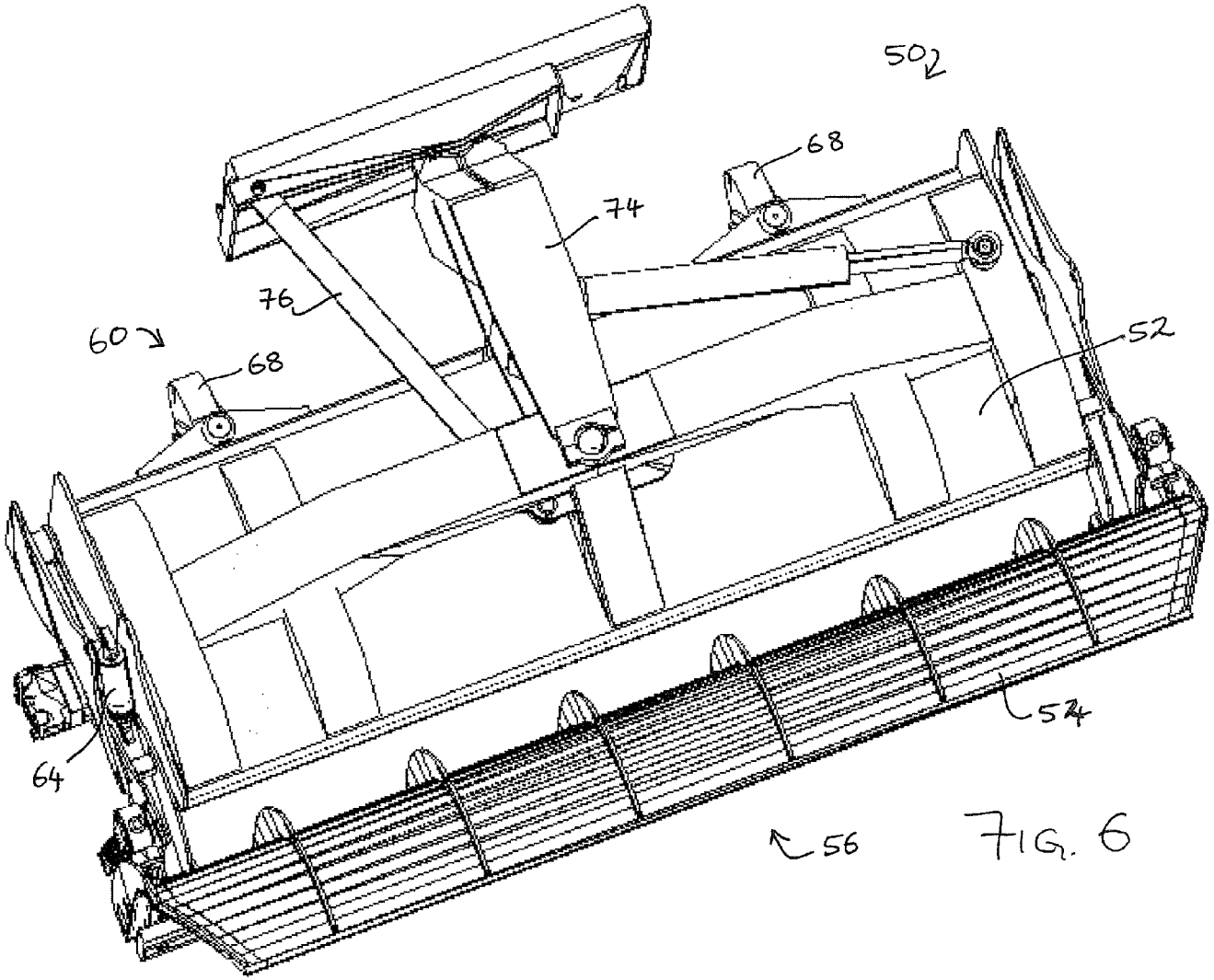
FIG. 6 is a perspective view of the apparatus of FIG. 3, in perspective view from in front and above.

The result is that the first and second pivot arms 74, 76 have each pivoted about their respective proximal axes of rotation 92, 96 in a clockwise rotation as the body 52 and its axis A-A has rotated in a counter-clockwise direction relative to the vehicle mounting 70. As a consequence the distal axes of rotation have moved laterally towards the vehicle's right (relative to FIG. 7), and this has pulled the entire body sideways, offsetting the normal lateral movement which would result from a conventional rear-mounted pivot as shown in FIGS. 1 and 2. It can thus be seen that the path which will be ploughed, defined by the rearward projection or track between the outermost edges 104, 106 of the plough blade, continues to coincide with the tracks of the wheels 80, 82.

Figure 9:
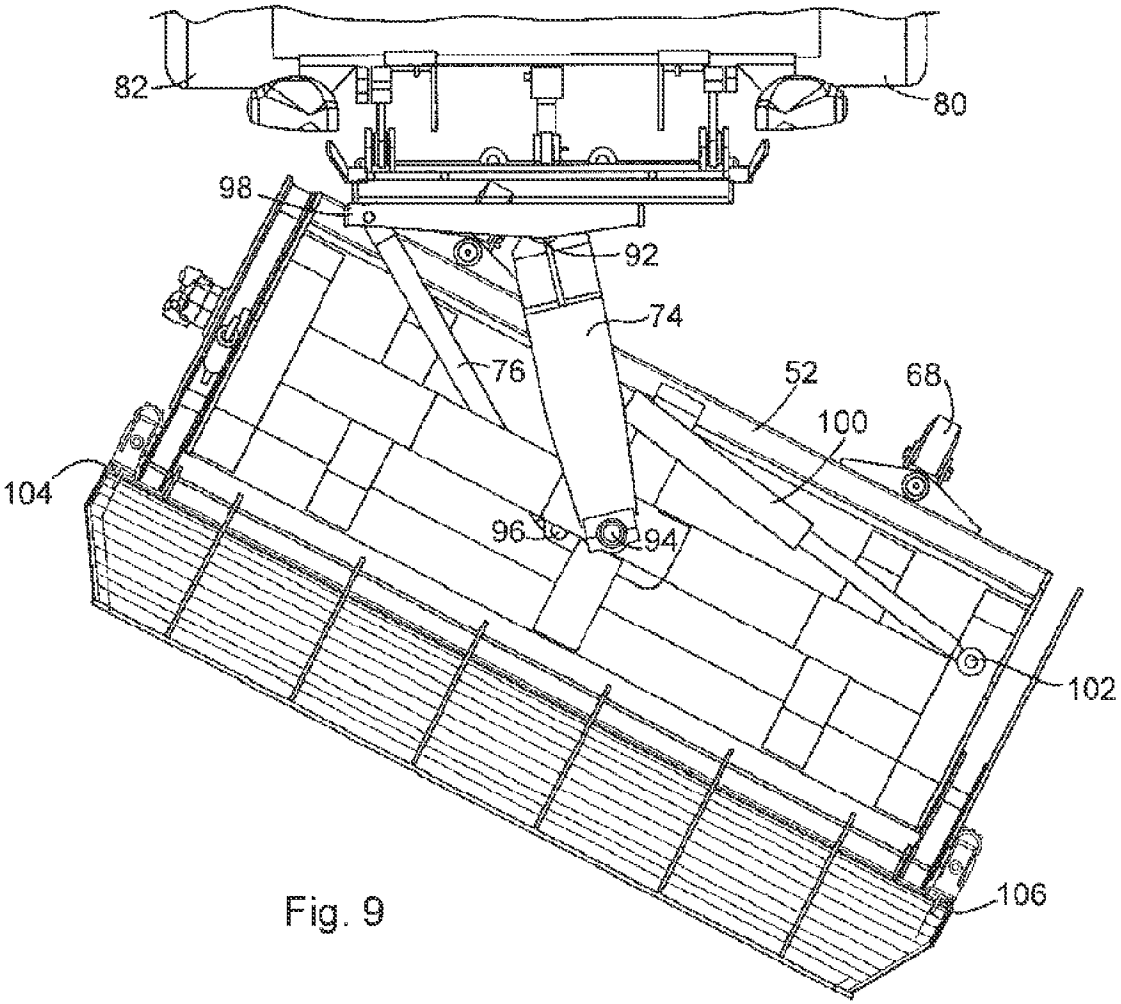
FIG. 9 is a top plan view, similar to FIG. 7, with the apparatus in a right-displacing configuration.

FIG. 9 shows the body when rotated fully in the opposite direction, i.e. with the cylinder 100 fully extended and the plough in a right-displacing configuration. Now the shape of the quadrilateral 92, 94, 96, 98 has distorted in the opposite manner relative to the FIG. 7 shape, with the distal axes of rotation (and hence the apparatus body 52) shifted to the vehicle's left, i.e. as the body rotates clockwise, the first and second pivot arms 74, 76 rotate counter-clockwise about their proximal axes of rotation 92, 98.

It can again be seen that this has the effect of keeping the track defined between the plough blade edges 104, 106, aligned with the track of the wheels 80, 82 when the vehicle drives straight ahead. (It is noted that as shown in FIGS. 8 and 9, the castors 68 have not rotated to trail along the line of the direction of travel as they would in fact do if the apparatus was driven in contact with the ground.)

Figure 10:
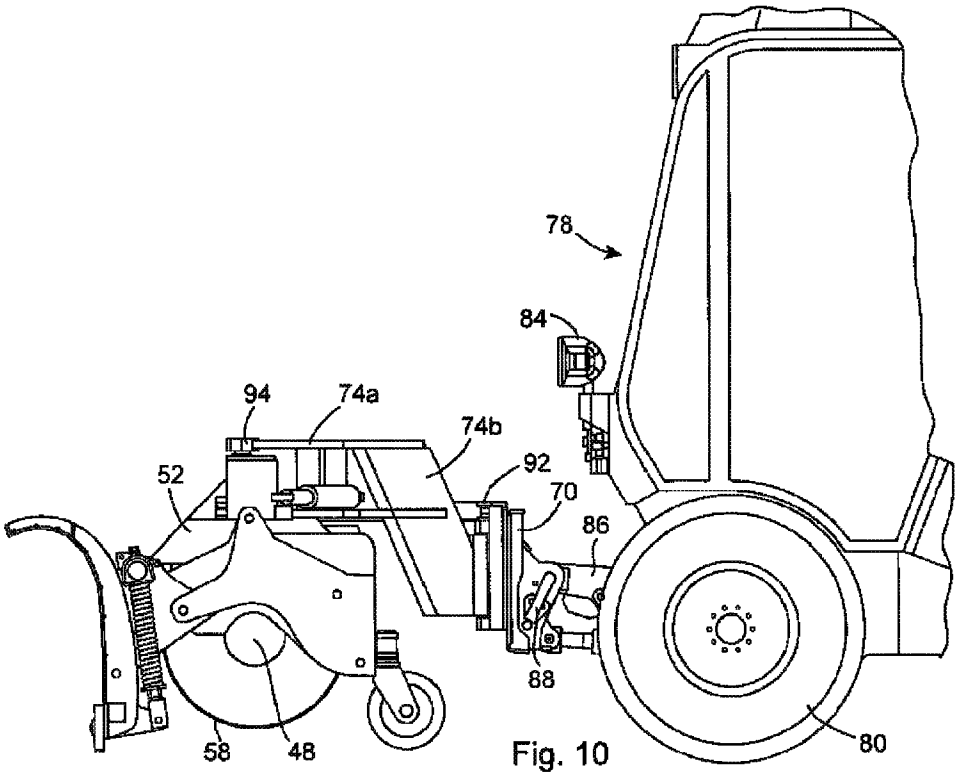
FIG. 10 is a side elevation of the apparatus of FIG. 7, shown from the vehicle's left-hand side is a top plan view, similar to FIG. 7, with the apparatus in a left-displacing configuration.
Figure 11:
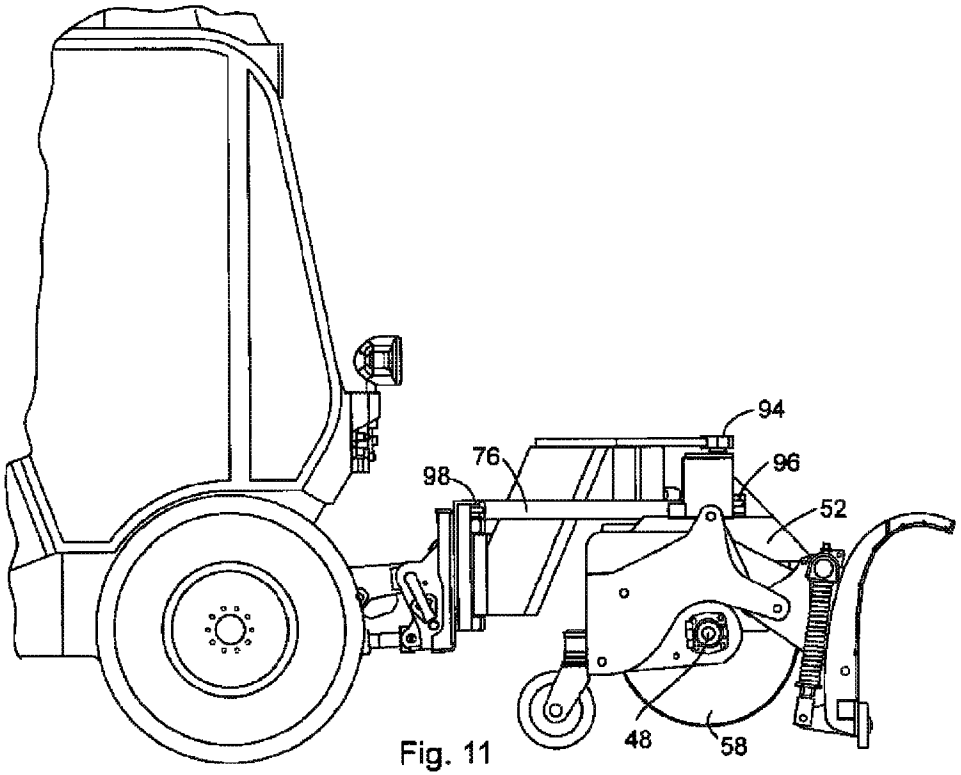
FIG. 11 is a side elevation of the apparatus of FIG. 7, shown from the vehicle's right-hand side is a top plan view, similar to FIG. 7, with the apparatus in a right-displacing configuration.

FIGS. 10 and 11 show the arrangement of FIG. 7 from either side, i.e. the front of the vehicle 78 with its pick-up and mounting structure 88 in engagement with the apparatus's vehicle mounting 70. It can be seen in this view that arm 74 is in two sections 74*a* and 74*b*. Section 74*a* extends rearwardly from the first distal axis of rotation or pivot point 94, over the top of the vehicle body 52, and section 74*b* connects downwardly at an angle to the first proximal axis of rotation 92 at the vehicle mounting 70.

The second pivot arm, best seen in FIG. 11, extends in a straight line, between the second distal axis 96 and second proximal axis 98, again over the top of the body 52 and above the brush.

This has the effect of allowing the distal axes of rotation to be positioned forwardly of the rear of the body and even forwardly of the axis 48 of the brush 58. In this way, the centre of pivoting of the body, defined by the distal axes of rotation, is at a point which is between the brush axis and the blade, minimising the extent to which the brush and blade swing out to the side when the body is pivoted.

When compared with the arrangement in FIGS. 1 and 2, the result is that the snowplough and brush can clean the path along which the wheels will travel, without requiring an unduly wide blade.

Thus, if the width of the blade, as measured by the distance between the edges 104, 106 (FIGS. 7-9), is w, the effective ploughing path, as defined by the rearward projection of those edges (FIGS. 8 and 9) will be w(cos $\alpha$) where $\alpha$ is the angle of rotation of the axis A-A from its centred position as shown in FIG. 7. In FIGS. 8 and 9, a is approximately 30 degrees.

The geometry of the arrangement, taking into account the depth of the body from front to back, and the compensation against lateral swinging provided by the first and second pivot arms, means that the working width of the vehicle and snowplough accessory is within 85 mm of its mean width (as in FIG. 7) throughout the entire range of angles of rotation moving from FIG. 8 to FIG. 7 to FIG. 9.

Put another way, if one considers that the width of the exemplary snowplough and vehicle in FIG. 7 is 1500 mm, i.e. with the plough in the neutral position. One could drive this vehicle in a straight line along the centre of a pathway of constant width 1670 mm (i.e. 85 mm more than the neutral working width on either side), while swinging the plough out to one side (FIG. 8) or the other (FIG. 9). This provides a significant advantage when working in tight areas such as along footpaths or among machinery and equipment such as aeroplanes. In contrast, the neutral width of a commercially available (larger) snowplough is 2400 mm, but to accommodate this vehicle in the same manner one would need a path of width 3100 mm, i.e. on each side it swings out by a further 350 mm as it is slanted towards that side as shown in e.g. FIG. 2. Since the difference of scale is linear, the comparative percentage figures (i.e. 85 mm as a percentage of 1500 mm, and 350 mm as a percentage of 2400 mm) are 5.6% for the illustrated embodiment of the invention and 14.6% for the conventional snowplough of FIG. 1.

It is to be understood that the snowplough may be made in many different widths to fit different vehicles and to be used in various environments. No limitation to particular dimensions is in any way implied by the comparison of these different embodiments, which simply illustrate the advantages of employing the claimed invention.

The apparatus of FIGS. 3-11 also includes several hydraulic lines (not shown) for connection to hydraulic feed lines provided from the vehicle (not shown). These hydraulic lines power the apparatus for rotation of the brush, and for raising of the blade.

The invention is not limited to the embodiments shown which may be varied or modified without departing from the scope of the invention as defined by the statements of invention herein.

The invention claimed is:

1. An apparatus for removing unwanted material from the ground when the apparatus is driven across the ground by a vehicle, the apparatus comprising:

a vehicle mounting permitting attachment of the apparatus to a vehicle;

a body supporting a path-clearing blade, the blade having a longitudinal axis generally parallel to the ground in use, defining an axis of the body; and a jointed connection between the vehicle mounting and the body permitting the axis of the body to rotate within a plane generally parallel to the ground in use, the jointed connection comprising:

a rigid first pivot arm pivotally connected about a first proximal axis of rotation relative to the vehicle mounting and pivotally connected about a first distal axis of rotation relative to the body, the first pivot arm comprising a load bearing arm having a distal portion extending over the body and being pivotally connected to the body about the first distal axis of rotation, and a rigid second pivot arm pivotally connected about a second proximal axis of rotation relative to the vehicle mounting and pivotally connected about a second distal axis of rotation relative to the body, the second pivot arm being a non-load bearing arm, wherein as the body's axis rotates in the clockwise sense relative to the ground, the first and second arms each pivot in a counter-clockwise sense about their respective proximal axes of rotation, and vice versa.

2. An apparatus according to claim 1, wherein the separation between the first and second proximal axes of rotation is greater than the separation between the first and second distal axes of rotation.

3. An apparatus according to claim 1, wherein the four axes of rotation define the vertices of a quadrilateral, with the first and second pivot arms defining two of the opposed sides of the quadrilateral, where the quadrilateral tapers from the mounting end towards the body end.

4. An apparatus according to claim 1, wherein the geometry of the arms and the axes of rotation is selected to constrain the body to always lie within substantially the same width, regardless of the angle of rotation adopted by the body.

5. An apparatus according to claim 1, wherein the lateral extremities of the body, when rotated away from a neutral position, do not stray by more than a threshold amount on either side outside the body's lateral extent when it is in the neutral position, said threshold amount being not more than 12.5% of the plough blade's width.

6. An apparatus according to claim 1, wherein a driven means for moving the body relative to the mounting is provided.

7. An apparatus according to claim 1, further comprising a rotatable brush disposed on the body.

8. An apparatus according to claim 7, wherein the vertical height of the blade can be varied relative to the brush to selectively bring either the brush or blade into proximity or contact with the ground.

9. An apparatus according to claim 7, wherein the distal axes of rotation are disposed forwardly of the rear edge of the brush in the direction of the blade.

10. A snowplough accessory for mounting on a vehicle, comprising:

a body supporting a snowplough blade at a front side thereof, the blade having a longitudinal axis generally parallel to the ground in use, defining an axis of the body;

a rotatable cylindrical brush mounted on the body rearwardly of the snowplough blade with its axis parallel to the axis of the body;

a vehicle mounting permitting attachment of the apparatus to a vehicle; and a pivoting connection between the vehicle mounting and the body permitting the axis of the body to rotate within a plane generally parallel to the ground in use, the pivoting connection comprising:

a rigid first pivot arm pivotally connected about a first proximal axis of rotation relative to the vehicle mounting and pivotally connected about a first distal axis of rotation relative to the body, the first distal axis of rotation being located forward of the rear edge of the brush, the first pivot arm comprising a load bearing arm and having a distal portion extending over the top of the brush and being pivotally connected to the body about the first distal axis of rotation such that in normal use the brush is located below the first pivot arm and above the ground, and a rigid second pivot arm pivotally connected about a second proximal axis of rotation relative to the vehicle mounting and pivotally connected about a second distal axis of rotation relative to the body, the second pivot arm being a non-load bearing arm.

11. A snowplough accessory as claimed in claim 10, wherein the first distal axis of rotation is located forward of the axis of rotation of the brush.

12. A snowplough accessory as claimed in claim 10, wherein the first pivot arm is pivotally connected about the first proximal axis of rotation relative to the vehicle mounting and is pivotally connected to the body about the first distal axis of rotation, and the second pivot arm is pivotally connected about the second proximal axis of rotation relative to the vehicle mounting and is pivotally connected about the second distal axis of rotation relative to the body, so that as the body's axis rotates in the clockwise sense relative to the ground, the first and second pivot arms each pivot in a counter-clockwise sense about their respective proximal axes of rotation, and vice versa.

13. A snowplough accessory according to claim 10, wherein the separation between the first and second proximal axes of rotation is greater than the separation between the first and second distal axes of rotation, the four axes of rotation defining the vertices of a quadrilateral, with the first and second pivot arms defining two of the opposed sides of the quadrilateral, where the quadrilateral tapers from the mounting end towards the body end.

14. A snowplough accessory according to claim 10, wherein the geometry of the first and second pivot arms and the four axes of rotation is selected to constrain the body to always lie within substantially the same width, regardless of the angle of rotation adopted by the body.

15. A snowplough accessory according to claim 10, further comprising a driven means for moving the body relative to the mounting.

16. A snowplough accessory according to claim 10, wherein the vertical height of the blade can be varied relative to the brush to selectively bring either the brush or blade into proximity or contact with the ground.

17. A snowplough accessory according to claim 10, wherein both of the first distal axis of rotation and the second distal axis of rotation are disposed forwardly of the axis of the rotatable brush in the direction of the blade.

18. A snowplough accessory according to claim 10, wherein the lateral extremities of the body, when rotated away from a neutral position, do not stray by more than a threshold amount on either side outside the body's lateral extent when it is in the neutral position, said threshold amount being not more than 12.5% of the plough blade's width.

19. An apparatus according to claim 7, wherein at least one of the distal axes of rotation is disposed forwardly of the axis of the rotatable brush in the direction of the blade.

20. A snowplough comprising an apparatus for removing unwanted material from the ground when the apparatus is driven across the ground by a vehicle, the apparatus comprising:

(a) a vehicle mounting permitting attachment of the apparatus to a vehicle;

(b) a body supporting a path-clearing blade, the blade having a longitudinal axis generally parallel to the ground in use, defining an axis of the body; and (c) a jointed connection between the vehicle mounting and the body permitting the axis of the body to rotate within a plane generally parallel to the ground in use, the jointed connection comprising:

(i) a rigid first pivot arm pivotally connected about a first proximal axis of rotation relative to the vehicle mounting and pivotally connected about a first distal axis of rotation relative to the body, the first pivot arm comprising a load bearing arm having a distal portion extending over the body and being pivotally connected to the body about the first distal axis of rotation, and (ii) a rigid second pivot arm pivotally connected about a second proximal axis of rotation relative to the vehicle mounting and pivotally connected about a second distal axis of rotation relative to the body, the second pivot arm being a non-load bearing arm, wherein as the body's axis rotates in the clockwise sense relative to the ground, the first and second arms each pivot in a counter-clockwise sense about their respective proximal axes of rotation, and vice versa.

21. A snowplough comprising a snowplough accessory, the snowplough accessory comprising:

a body supporting a snowplough blade at a front side thereof, the blade having a longitudinal axis generally parallel to the ground in use, defining an axis of the body;

a rotatable cylindrical brush mounted on the body rearwardly of the snowplough blade with its axis parallel to the axis of the body;

a vehicle mounting permitting attachment of the apparatus to a vehicle; and a pivoting connection between the vehicle mounting and the body permitting the axis of the body to rotate within a plane generally parallel to the ground in use, the pivoting connection comprising:

a rigid first pivot arm pivotally connected about a first proximal axis of rotation relative to the vehicle mounting and pivotally connected about a first distal axis of rotation relative to the body, the first distal axis of rotation being located forward of the rear edge of the brush, the first pivot arm comprising a load bearing arm and having a distal portion extending over the top of the brush and being pivotally connected to the body about the first distal axis of rotation such that in normal use the brush is located below the first pivot arm and above the ground, and a rigid second pivot arm pivotally connected about a second proximal axis of rotation relative to the vehicle mounting and pivotally connected about a second distal axis of rotation relative to the body, the second pivot arm being a non-load bearing arm.

* * * * *